US006539592B1

(12) United States Patent
Choi et al.

(10) Patent No.: US 6,539,592 B1
(45) Date of Patent: Apr. 1, 2003

(54) BAND BUCKLE

(75) Inventors: Kwang-Moon Choi, Kyunggi-do (KR); Kwang-Ho Pyo, Incheon-si (KR)

(73) Assignee: Hong Jin Crown Co., Ltd. (KR)

( * ) Notice: Subject to any disclaimer, the term of this patent is extended or adjusted under 35 U.S.C. 154(b) by 0 days.

(21) Appl. No.: 10/059,944

(22) Filed: Jan. 29, 2002

(30) Foreign Application Priority Data

Dec. 13, 2001 (KR) ..... 01-0078779

(51) Int. Cl.[7] ..... A44B 11/00

(52) U.S. Cl. ..... 24/197; 24/194; 24/196; 24/182; 24/265 AL; 2/195.2

(58) Field of Search ..... 24/197, 196, 194, 24/182, 265 AL, 265 CD; 2/195.2, 195.3

(56) References Cited

U.S. PATENT DOCUMENTS 477,056 A * 6/1892 Kirkpatrick ..... 24/197
1,697,833 A * 1/1929 Lane ..... 24/296
2,853,757 A * 9/1958 Rave ..... 24/197
4,299,014 A * 11/1981 Wood ..... 24/197
5,915,535 A * 6/1999 Henrekin-Jordan ..... 2/195.2

* cited by examiner

*Primary Examiner*—Victor Sakran
(74) *Attorney, Agent, or Firm*—R. Neil Sudol; Henry D. Coleman; William J. Sapone

(57) ABSTRACT

The present invention relates to a band buckle which is capable of fabricating a buckle based on a set formed of an upper ring and a lower ring, quickly releasing a bound force of an adjusting band by easily lifting only the upper ring when the adjusting band is inserted, and implementing an easier fabrication of a buckle and decreasing the fabrication cost of the same by forming a support portion in a rear end inner side surface of the lowering without forming the support portion in the upper ring. In the band buckle includes, the upper ring includes a handle protruded from both side surfaces of the front end potion of the same by more than the width, and the lower ring includes a support portion which is formed in such a manner that an extended portion is formed in an inner side of the through hole of the inner end portion and is bent upwardly in the band buckle which includes an upper ring and a lower ring each having a through hole and a fixing stripe which binds the rear ends of the upper ring and the lower ring.

2 Claims, 7 Drawing Sheets

BAND BUCKLE

BACKGROUND OF THE INVENTION

1. Field of the Invention

The present invention relates to a band buckle, and in particular to a band buckle which is capable of implementing a simple construction of an upper ring and lower ring of a buckle for binding an adjusting band, so that it is possible to obtain an easier and stable engagement.

2. Description of the Background Art

Generally, as shown in FIG. 1, a band buckle is used for binding two thin and wide bands and unbinding the same.

FIG. 1 is a view illustrating a conventional binding band for a helmet. As shown therein, the helmet is generally used when a user rides a two-wheeled vehicle or for a construction site. In addition, the helmet is used when a user enjoys a dynamic leisure activity such as an inline skate, skate board, etc. for thereby protecting a user's head. When a user wears the above helmet, in order to prevent the movement of the helmet, as shown in FIG. 2, a fixing band 10 and an adjusting band 20 are bound each other and are unbound. At this time, a band buckle is used.

As shown in FIG. 2, the conventional buckle 30 includes an upper ring 31 and a lower ring 32 each having a through hole 33, a fixing stripe 11 for binding the rear ends of the same, and a fixing band 10 in which the fixing stripe 11 is connected by a sewing method. The above conventional buckle 20 is disclosed in the Korean Utility Model Registration No. 20-0190125.

In detail, as shown in FIG. 3, an inverted L-shaped support portion 34 is formed in a rear end portion of the upper ring 31 in such a manner that the widths of the same are same, and the length of the lower ring 32 is slightly longer than the length of the upper ring 31, so that the inverted L-shaped support portion 34 covers the rear end corner portion of the lower ring 32, and the end surface does not cover beyond the inner surface of the through hole of the lower ring 32.

Therefore, the adjusting stripe 21 of the adjusting band 20 is inserted through the lower ring 32 and the upper ring 31, and the end portion of the same is wound on the end portion of the upper ring 31 and then is inserted into the through hole 33 of the lower ring 32 and is tightened in a longitudinal direction for thereby binding the adjusting stripe 21 of the adjusting band. As the adjusting stripe 21 is more strongly tightened, since the upper ring 31 more strongly presses the adjusting stripe 21 which passes between the upper ring 31 and the lower ring 32, so that the buckle is not easily unlocked. At this time, even when the user moves the hands from the buckle, since the friction force between the adjusting stripe 21, the upper ring 31 and the lower ring 32 is larger than the unbinding force, the bound state is stably maintained.

The conventional buckle has the following disadvantages.

Namely, when unlocking the buckle 30 which is stably locked and then drawing the adjusting stripe 21 of the adjusting band 20, it is needed to slightly release the tightened state of the adjusting band 20, and the protrusion 35 of the lower ring 32 is upwardly lifted, and the upper ring 31 decreases the force which presses the adjusting stripe 21 between the lower ring 32.

In a state that the adjusting band 20 is stably engaged using the buckle 30, it is not easy to release the tension force of the adjusting band 20. In addition, when quickly unlocking the buckle, when the lower ring 32 is lifted, the upper ring 31 is lifted together with the lower ring 32. Therefore, the bound state with respect to the adjusting stripe 21 of the adjusting band 20 is not unbound, but is maintained.

Therefore, in order to quickly unlock the buckle 30, only the upper ring 31 is lifted for thereby widening the distance between the upper ring 31 and the lower ring 32 without lifting the lower ring 32.

As described above, in order to easily unlock the buckle 30, it is effective to lift the upper ring 31. Since the conventional buckle 30 has the same width as the widths of the upper ring 31 and the lower ring 32, it is inconvenient to lift the upper ring 31 which has a relatively thin thickness.

When the buckle 30 is bound using the fixing stripe 11, when the front surface of the lower ring 32 and the back surface of the upper ring 31 are too closely contacted, since the buckle 11 is bound by the fixing stripe 11 having a double thickness, it is impossible to insert the adjusting stripe 21 into the holes. In addition, since the end portion of the lower ring 32 and the end portion of the upper ring 31 is distanced more, in a state that the adjusting stripe 21 is passed, it is impossible to shrink the same, so that there is a certain obstruction for enhancing the engaging force.

Therefore, as shown in FIG. 3, the inner end portion of the upper ring 31 is bent in an inverted L-shape. The inner end portion of the upper ring 31 has the same thickness as the inner end portion of the lower ring 32 for thereby being bound with the fixing stripe.

However, in the above structure, it is very difficult to insert the set of the upper ring 31 and the lower ring 32 into the fixing stripe 11 for thereby finishing the buckle 30. In particular, since the entire rear end portions of the upper ring 31 are bent, in the case the thickness is thick, it is impossible to fabricate the same.

Namely, in the case that the entire widths are bent in the rear end portion of the upper ring 31, a large force is required for bending the same. In addition, the end corners of the lower ring 32 must contact with the bent corner portions. For the above reason, it is needed to form a 90° corner. In this case, it is impossible to form the above 90° corner based on only the bending operation.

In addition, since the length of the upper ring 31 is previously set by the length which will be bent, the consumption of the material is increased.

SUMMARY OF THE INVENTION

Accordingly, it is an object of the present invention to provide a band buckle which overcomes the problems encountered in the conventional art.

It is another object of the present invention to provide a band buckle which is capable of fabricating a buckle based on a set formed of an upper ring and a lower ring.

It is further another object of the present invention to provide a band buckle which is capable of quickly releasing a bound force of an adjusting band by easily lifting only the upper ring when the adjusting band is inserted.

It is still further another object of the present invention to provide a band buckle which is capable of implementing an easier fabrication of a buckle and decreasing the fabrication cost of the same by forming a support portion in a rear end inner side surface of the lowering without forming the support portion in the upper ring.

To achieve the above objects, there is provided a band buckle in which the upper ring includes a handle protruded from both side surfaces of the front end potion of the same by more than the width, and the lower ring includes a support portion which is formed in such a manner that an extended portion is formed in an inner side of the through hole of the inner end portion and is bent upwardly in the band buckle which includes an upper ring and a lower ring each having a through hole and a fixing stripe which binds the rear ends of the upper ring and the lower ring.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The embodiments of the present invention will be described with reference to the accompanying drawings.

Figure 1:
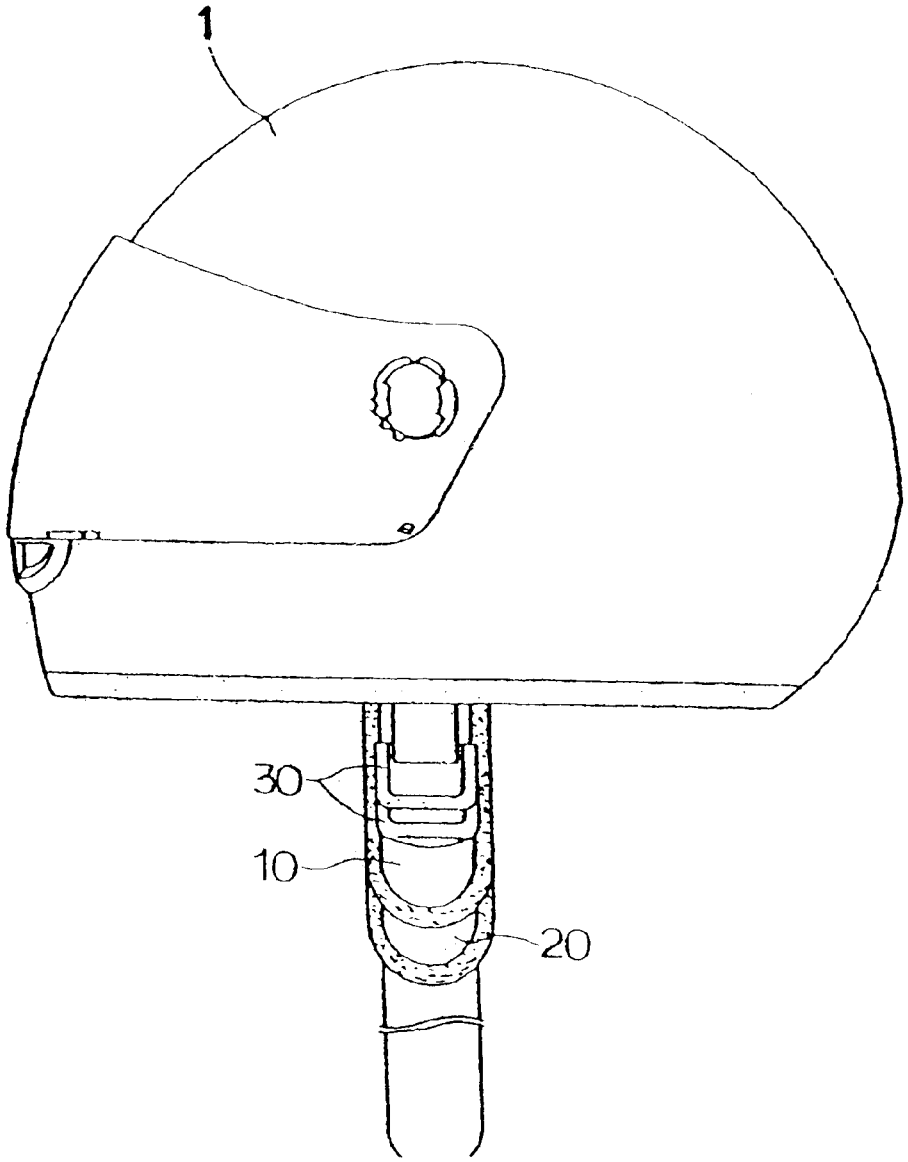
FIG. 1 is a cross-sectional view illustrating a conventional band buckle for a helmet.
Figure 2:
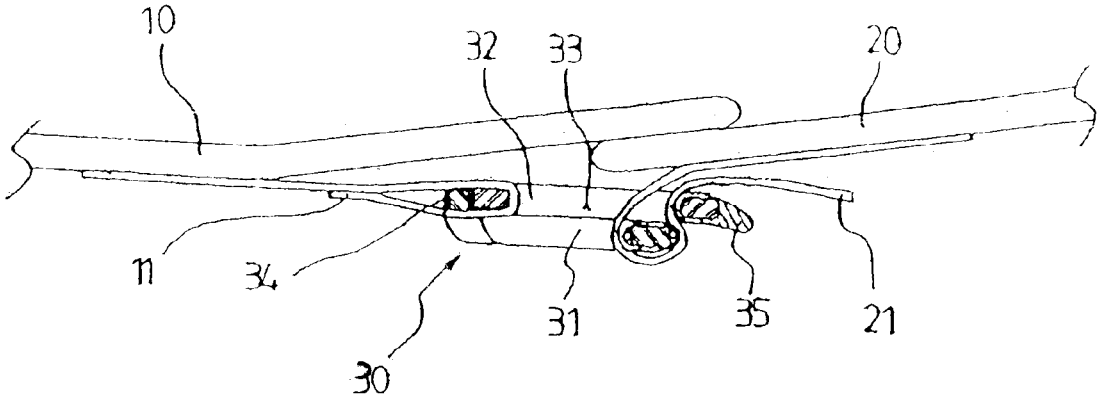
FIG. 2 is a cross-sectional view illustrating a conventional buckle.
Figure 3:
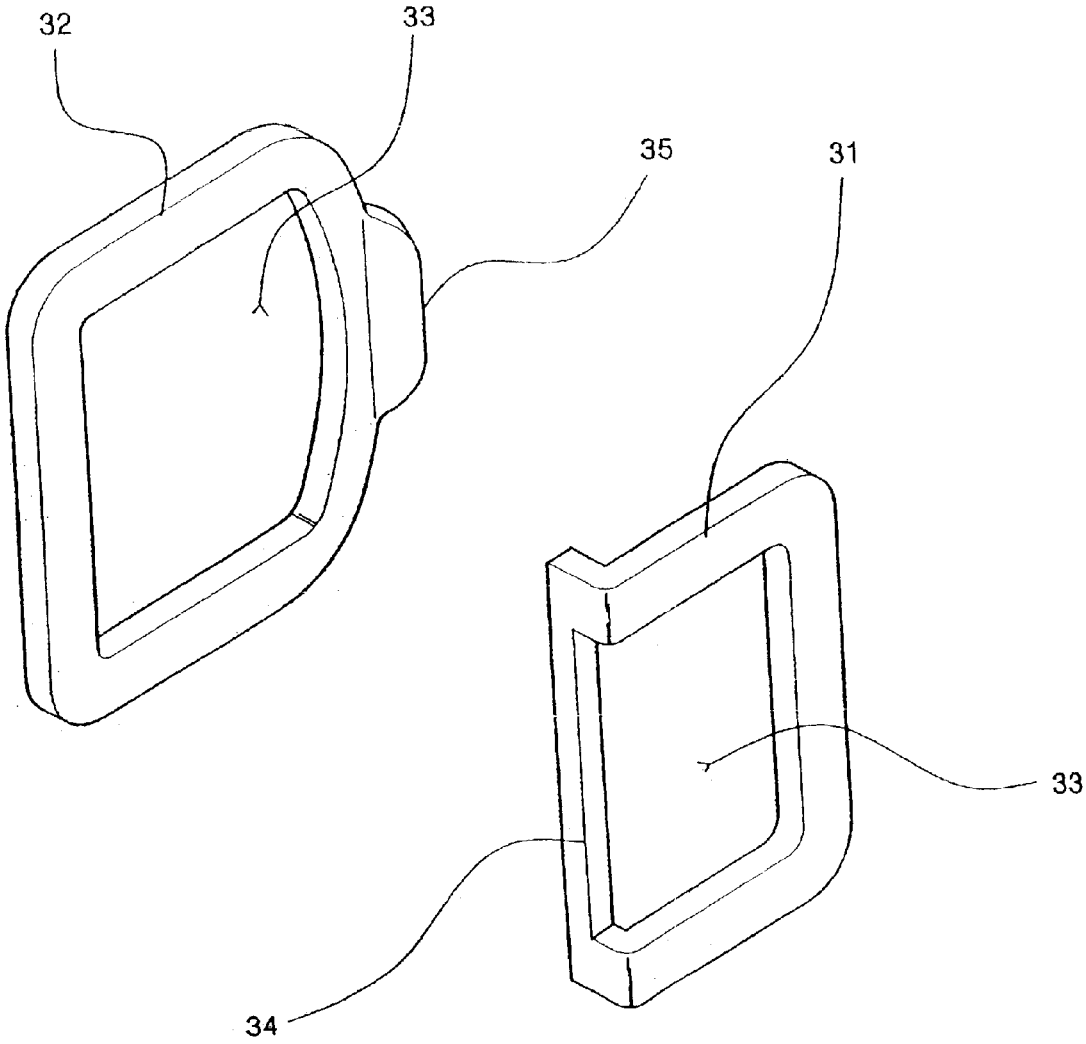
FIG. 3 is a perspective view illustrating a conventional upper ring and lower ring.
Figure 4:
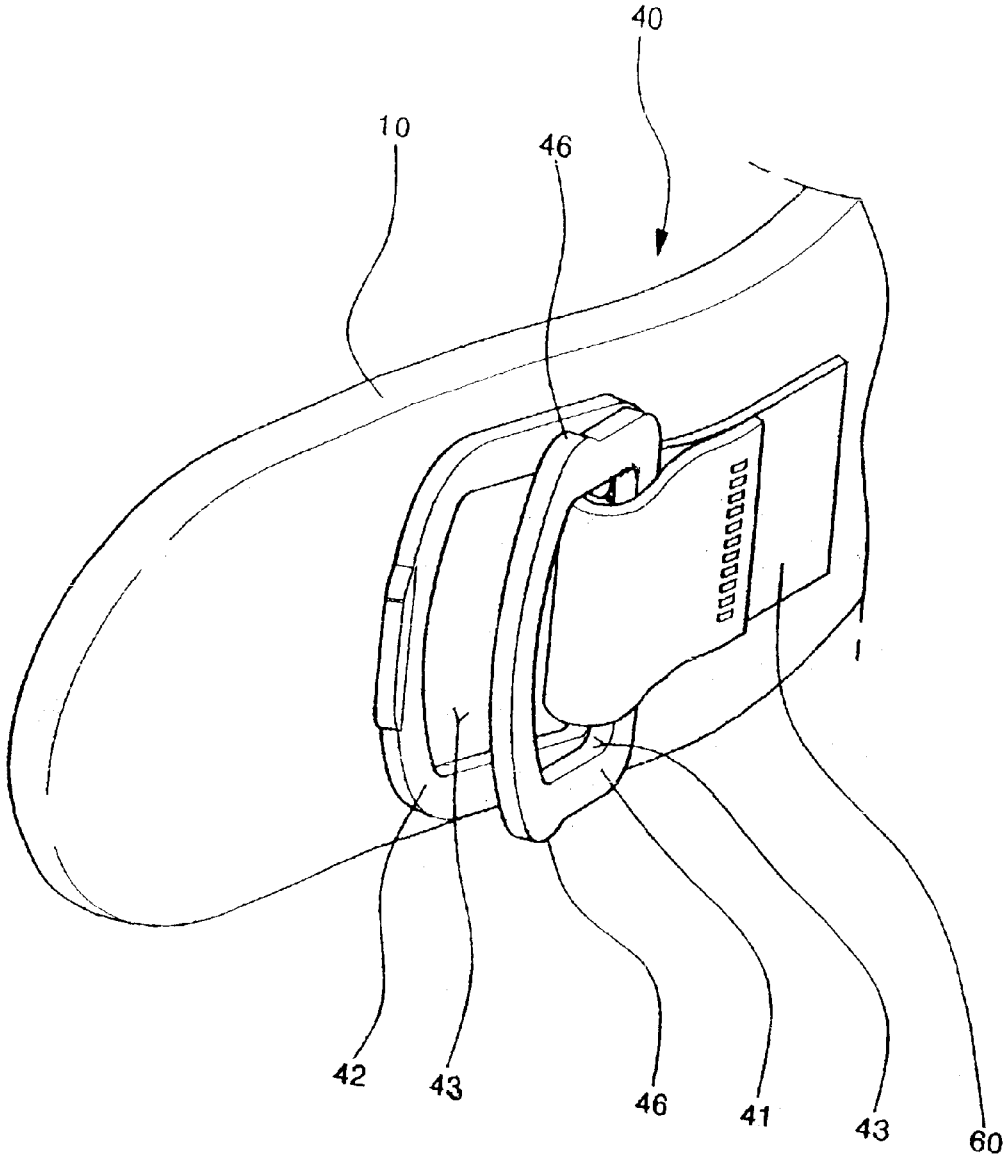
FIG. 4 is a perspective view illustrating a band buckle according to the present invention.
Figure 5:
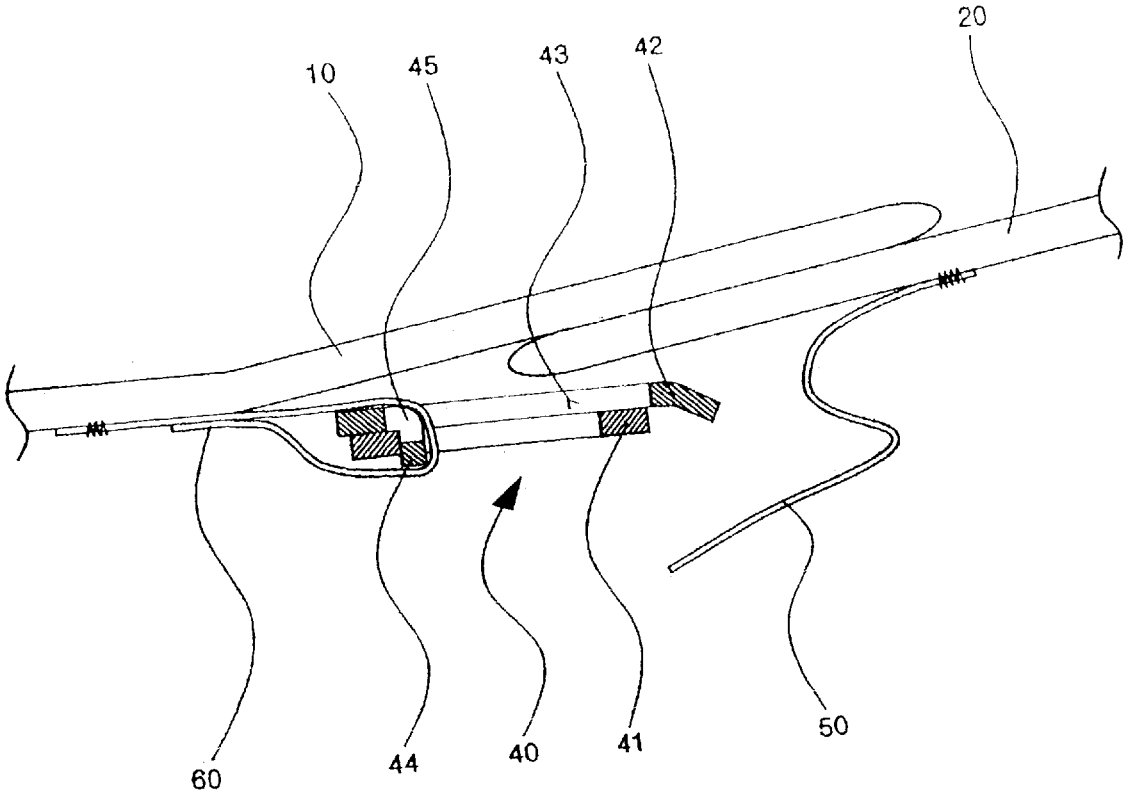
FIG. 5 is a cross-sectional view illustrating a band buckle according to the present invention.
Figure 6:
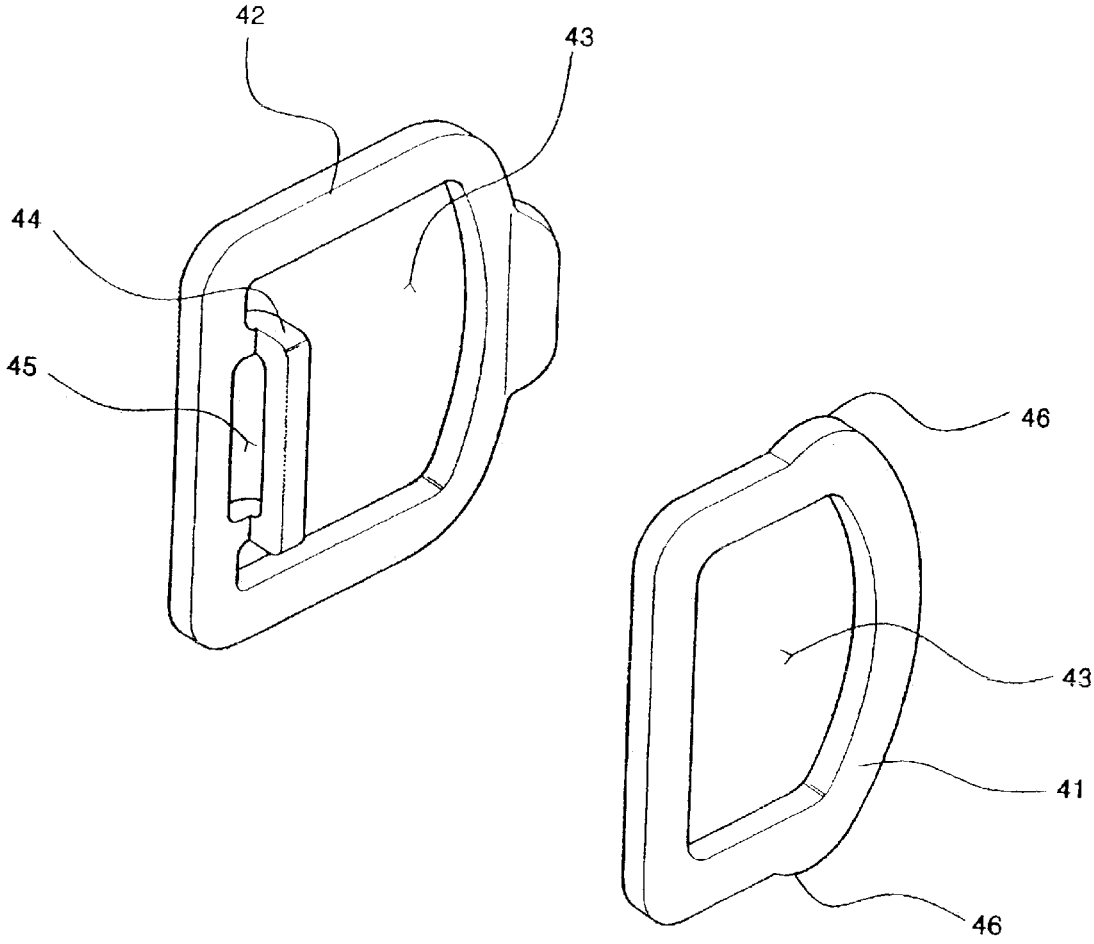
FIG. 6 is a detailed perspective view illustrating an upper ring and lower ring according to the present invention.
Figure 7:
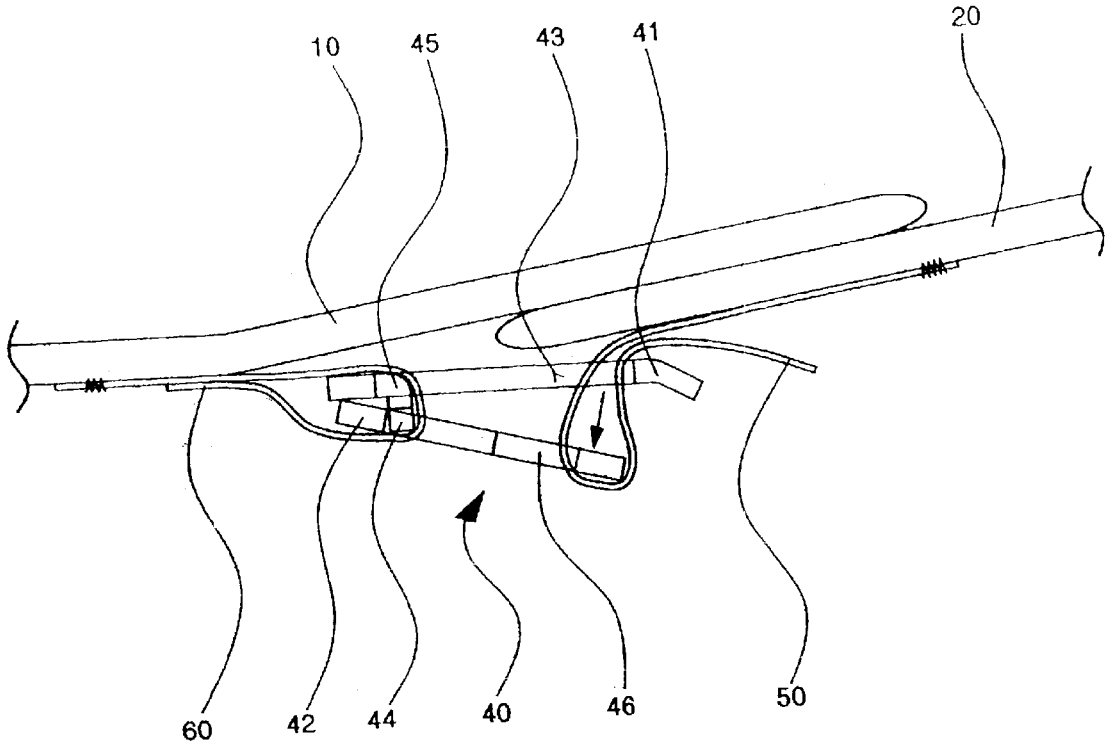
FIG. 7 is a view illustrating a state of use of a band buckle according to the present invention.

FIG. 4 is a perspective view illustrating the buckle according to the present invention, and FIG. 5 is a cross-sectional view illustrating the buckle according to the present invention.

As shown therein, the construction of the buckle 40 which is formed of an upper ring and a lower ring 41 each having a through hole 43, and a fixing stripe 60 which binds the both ends of the same is the same as the conventional art.

However, in the present invention, the upper ring 41 includes a handle 46 which is protruded from the both side surfaces of the front end portion of the same and has a protruded height larger than the width. The lower ring 42 includes an extended portion in an inner portion of the through hole 43 of the inner end for thereby forming a support portion 44 by upwardly bending the extended portion.

The handle 46 is preferably formed in a circular protrusion as shown in the drawings, and the protruded height is similar with the thickness of the upper ring 41.

The support portion 44 of the lower ring 42 includes a hole 45 for thereby being easily upwardly bent. The height of the support portion 44 is the same as the thickness of the upper ring 41.

As shown in FIG. 4, the buckle according to the present invention includes one set formed of the upper ring 41 and the lower ring 42. In a state that the inner surface of the through hole 43 of the upper ring 41 is closely contacted with the side surface of the support portion 44 of the lower ring 42, the rear end portions of the same are bound using the fixing stripe 60 for thereby fabricating the buckle 40.

When engaging the adjusting stripe 50 to the buckle 40, in a state that the upper ring 41 and the lower ring 42 are overlaid, the adjusting stripe 50 is inserted into the through hole 43 and the through hole 43 of the lower ring 42 in a sequence and then is tightened in the longitudinal direction for thereby binding the adjusting stripe 50.

At this time, as the adjusting stripe 50 is more tightly extended, the front end portion of the upper ring 41 more strongly presses the adjusting stripe 50 which passes between the upper ring 41 and the lower ring 42, the bound state is not easily unbound. In this state, even when the user's hand does not hold the same, since the friction force between the adjusting stripe 50, the upper ring 41 and the lower ring 42 is larger than the unbinding force, the bound state is continuously maintained.

When unbinding the bound state, the adjusting stripe 50 is held and lifted and then is released using one hand, and then the handle 46 of the upper ring 41 is held by the other hand, and the front end portion is lifted.

When the adjusting stripe 50 is held and upwardly lifted and then is released, the bound force between the fixing stripe 60 and the adjusting stripe 50 is decreased. In this state, the upper ring 41 is lifted, and the intermediate portion of the adjusting stripe 50 which is wound through the upper ring 41 and the lower ring 42 is loosened for thereby quickly unbinding the bound state.

In addition, in the buckle 40 according to the present invention, the support potion 44 is formed in the lower ring 42, not in the upper ring 41. Since a certain portion corresponding to the through hole 43 of the center of the upper ring 41 is to blanked during the pressing process, an extended portion is formed in the above portion, and then the extended portion is upwardly bent for thereby forming the support portion 44.

In the above construction according to the present invention, it is not needed to extend the length of the upper ring 41 for bending and forming the support portion. In addition, a hole 45 is formed in the center portion of the upper portion 44. Therefore, it is easy for bending the support portion at a 90°.

In addition, since the support portion 44 formed in the lower ring 42 is formed in an inner side of the through hole 43, it is easy to wind the fixing stripe 60. Namely, in a state that the upper ring 41 and the lower ring 42 are overlaid, when winding the fixing stripe 60 with holding the surrounding portion of the same, it is possible to easily to hold a certain portion thereof.

As described above, in the buckle according to the present invention, since the handle is protruded from left and right side surfaces of the upper ring, when unbinding the adjusting band, it is possible to easily lift the upper ring using the handle, so that it is possible to quickly release the bound force of the adjusting band. The support portion is formed in the lower ring in the through hole portion, so that it is possible to easily fabricate the buckle, and the consumption of the material is decreased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a band buckle which includes an upper ring and a lower ring each having a through hole and a fixing stripe which binds the rear ends of the upper ring and the lower ring, a band buckle in which the upper ring includes a handle protruded from both side surfaces of the front end potion of the same by more than the width, and the lower ring includes a support portion which is formed in such a manner that an extended portion is formed in an inner side of the through hole of the inner end portion and is bent upwardly.

2. The buckle of claim 1, wherein said support portion of the lower ring includes a hole for thereby implementing an easier bending in an upward direction.

* * * * *